US011904198B1

(12) United States Patent
Romano et al.

(10) Patent No.: US 11,904,198 B1
(45) Date of Patent: Feb. 20, 2024

(54) EXERCISE EQUIPMENT AND RELATED METHODS

(71) Applicant: China 2 West Services Ltd., Zhuhai (CN)

(72) Inventors: Jesus David Cano Romano, Phuket (TH); James Currie, Zhuhai (CN); John Rey Lobo, Manila (PH)

(73) Assignee: China 2 West Services Ltd., Zhuhai (CN)

( * ) Notice: Subject to any disclaimer, the term of this patent is extended or adjusted under 35 U.S.C. 154(b) by 0 days.

(21) Appl. No.: 18/375,412

(22) Filed: Sep. 29, 2023

Related U.S. Application Data

(63) Continuation of application No. 18/372,651, filed on Sep. 25, 2023.

(60) Provisional application No. 63/439,042, filed on Jan. 13, 2023.

(51) Int. Cl.

| | |
|---|---|
| ***A63B 21/00*** | (2006.01) |
| ***A63B 23/02*** | (2006.01) |
| ***A63B 23/04*** | (2006.01) |

(52) U.S. Cl.
CPC ..... *A63B 21/4029* (2015.10); *A63B 21/4035* (2015.10); *A63B 23/0233* (2013.01); *A63B 23/04* (2013.01)

(58) Field of Classification Search
CPC ..... A63B 21/4029; A63B 21/4035; A63B 23/0233; A63B 23/04
See application file for complete search history.

(56) References Cited

U.S. PATENT DOCUMENTS

| | | | | |
|---|---|---|---|---|
| 5,190,513 | A * | 3/1993 | Habing | A63B 23/0211 482/145 |
| 6,123,653 | A * | 9/2000 | Huang | A63B 21/4047 482/142 |
| D541,893 | S * | 5/2007 | Webber | D21/690 |
| 7,662,077 | B1 * | 2/2010 | Liu | A63B 23/02 482/142 |
| 2003/0109363 | A1 * | 6/2003 | Chen | A63B 21/4047 482/142 |
| 2006/0217249 | A1 * | 9/2006 | Webber | A63B 23/02 482/142 |
| 2017/0014681 | A1 * | 1/2017 | Doherty | A63B 23/02 |

* cited by examiner

*Primary Examiner* — Andrew S Lo
(74) *Attorney, Agent, or Firm* — Snell & Wilmer L.L.P.

(57) ABSTRACT

A number of embodiments include an exercise apparatus. The exercise apparatus can transition between a lowered configuration and a raised configuration. Each configuration can be used to perform the same or different exercises, such as a Nordic curl, back extension, abdominal crunch, and many others. The exercises apparatus can be transitioned between a lowered configuration and a raised configuration by hingedly actuating a first portion of the apparatus relative to a second portion of the apparatus. Various supporting and/or locking structures (e.g., pegs, sheaths, pop-pins, etc.) can be used to secure the apparatus in a lowered configuration and/or a raised configuration.

20 Claims, 21 Drawing Sheets

EXERCISE EQUIPMENT AND RELATED METHODS

CROSS-REFERENCE TO RELATED APPLICATIONS

This application is a continuation of application Ser. No. 18/372,651, entitled "EXERCISE EQUIPMENT AND RELATED METHODS", and filed Sep. 25, 2023. Application Ser. No. 18/372,651, in turn, is a non-provisional of and claims priority to U.S. Provisional Application No. 63/439,042, entitled "EXERCISE EQUIPMENT AND RELATED METHODS", and filed Jan. 13, 2023. The foregoing applications are herein incorporated by this reference in its entirety, including but not limited to those portions that specifically appear hereinafter, but except for any subject matter disclaimers or disavowals, and except to the extent that the incorporated material is inconsistent with the express disclosure herein, in which case the language in this disclosure shall control.

TECHNICAL FIELD

This disclosure relates generally to exercise equipment and more specifically to exercise equipment incorporating two or more configurations.

BACKGROUND

A varied fitness regimen is important for the health of many individuals in society, but both commercial and home gyms are often housed in areas with limited space. Due to this limited space, gym owners often forgo obtaining equipment with limited uses (e.g., only one exercise or configuration). Additional utility per square foot can be gained by obtaining equipment that can be utilizes for multiple uses. Therefore, there is a need for adjustable exercise equipment capable of transitioning between two or more configurations or able to perform two or more exercises.

SUMMARY

A number of embodiments can include an exercise apparatus. The exercise apparatus can include a top portion, a bottom portion, and a peg. The top portion can include a center post having a first end and a second end, a footrest coupled to the first end of the center post, an ankle post, and a cushion. The ankle post can (1) extend from a top surface of the center post, (2) be located between the footrest and the second end, and (3) create an approximately 90 degree angle with the center post. The cushion can be coupled to the top surface of the center post or coupled to a crossbar coupled to the center post. The peg can be hingedly coupled to the top portion. The bottom portion can include a foot. The exercise apparatus can be configured to transition from a lowered configuration where the top portion is in a lowered position to a raised configuration where the top portion is in a raised position by actuating the peg at a hinged coupling point. The center post, the footrest, and the ankle post remain in a same position relative to each other when in both the lowered position and the raised position.

Many embodiments can include a method for facilitating exercise with equipment capable of transitioning between two or more configurations. The method can comprise providing a top portion of an exercise apparatus, providing a bottom portion of the exercise apparatus, providing a peg hingedly coupled to the top portion, and transitioning the exercise apparatus from a lowered configuration where the top portion is in a lowered position to a raised configuration where the top portion is in a raised position. The top portion can include a center post having a first end and a second end, a footrest coupled to the first end of the center post, an ankle post, and a cushion. The ankle post can (1) extend from a top surface of the center post, (2) be located between the footrest and the second end, and (3) create an approximately 90 degree angle with the center post. The peg can be hingedly coupled to the top portion. The cushion can be coupled to the top surface of the center post or coupled to a crossbar coupled to the center post. The bottom portion can include a foot. The exercise apparatus can be configured to transition from a lowered configuration where the top portion is in a lowered position to a raised configuration where the top portion is in a raised position by actuating the peg at a hinged coupling point. The center post, the footrest, and the ankle post remain in a same position relative to each other when in both the lowered position and the raised position.

Various embodiments can include an exercise apparatus. The exercise apparatus can include a top portion, a bottom portion, and a peg. The top portion can include a center post having a first end and a second end, an ankle post coupled to a top surface of the center post, a footrest, =a cushion, and a peg. The footrest can (1) have an approximately planar shape, (2) be coupled to the first end of the center post, and (3) create an approximately 90 degree angle with the center post. The ankle post can be located between the footrest and the second end. The peg can be hingedly coupled to the top portion. The cushion can be coupled to the top surface of the center post or a crossbar coupled to the center post. The bottom portion can include a foot. The exercise apparatus can be configured to transition from a lowered configuration where the top portion is in a lowered position to a raised configuration where the top portion is in a raised position by actuating the peg at a hinged coupling point. The center post, the footrest, and the ankle post remain in a same position relative to each other when in both the lowered position and the raised position.

BRIEF DESCRIPTION OF THE DRAWINGS

To facilitate further description of the embodiments, the following drawings are provided in which.

Figure 1:
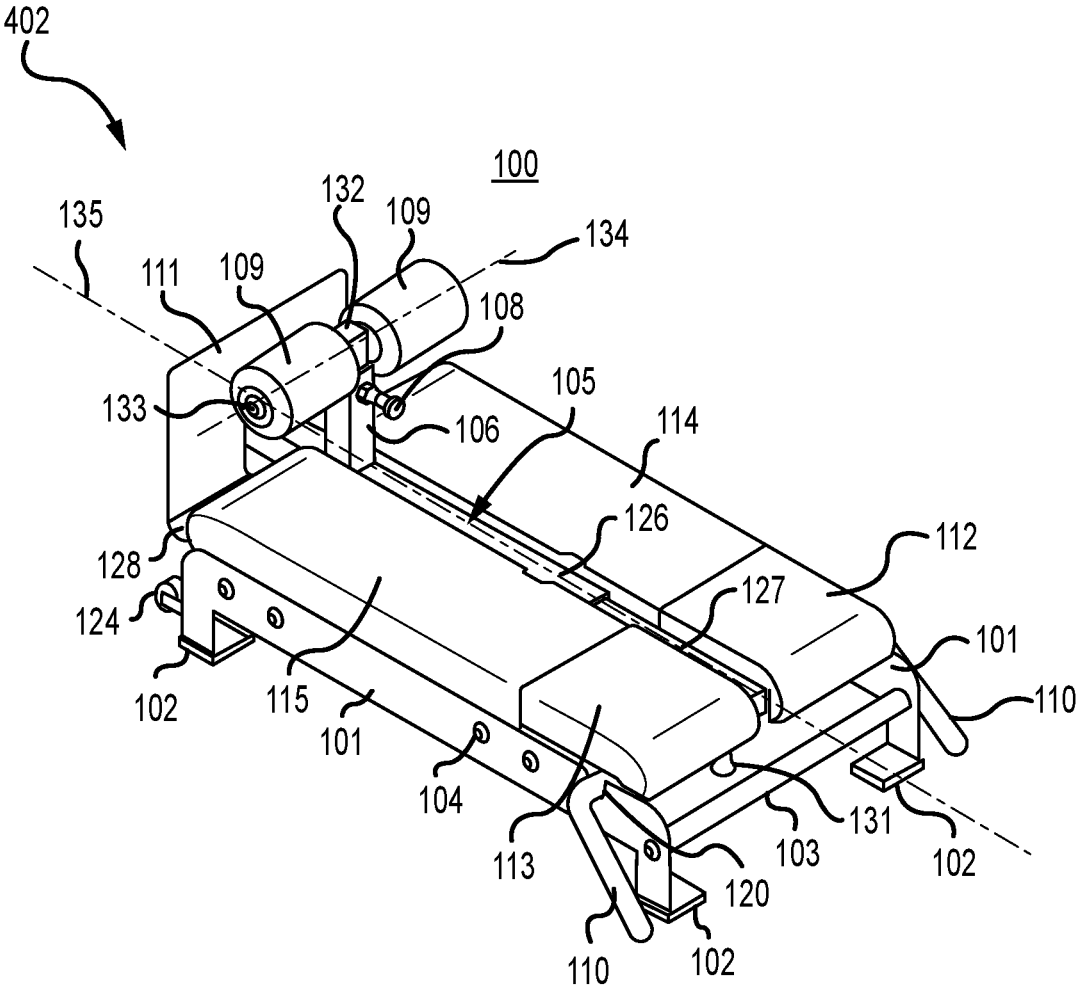
FIG. 1 illustrates an isometric view of an exemplary piece of exercise equipment in a first configuration.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DESCRIPTION OF EXAMPLES OF EMBODIMENTS

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

Turning now to the drawings, FIG. 1 shows an exemplary piece of exercise equipment 100. Equipment 100 is merely exemplary and is not limited to the embodiments presented herein. Equipment 100 can be employed in many different embodiments or examples not specifically depicted or described herein. Generally speaking, elements of equipment 100 can be made from a variety of materials. For example, elements of equipment 100 can be made from metal, wood, ceramic, plastic, or some other rigid and/or semi rigid material. Elements of equipment 100 can have a variety of different shapes and/or cross sections. For example, ankle post 106 is shown as having a generally rectangular cross section, but in other embodiments can have a circular, triangular, hexagonal, or other cross sections. As another example, crossbar 103 is shown as having a generally circular cross section, but in other embodiments can have a rectangular, triangular, hexagonal, or other cross sections. Elements of equipment 100 can be manufactured in a number of different ways. For example, elements of equipment 100 can be die cast, extruded, molded, rolled, bent, or created via some other type of industrial manufacturing process.

Figure 4A:
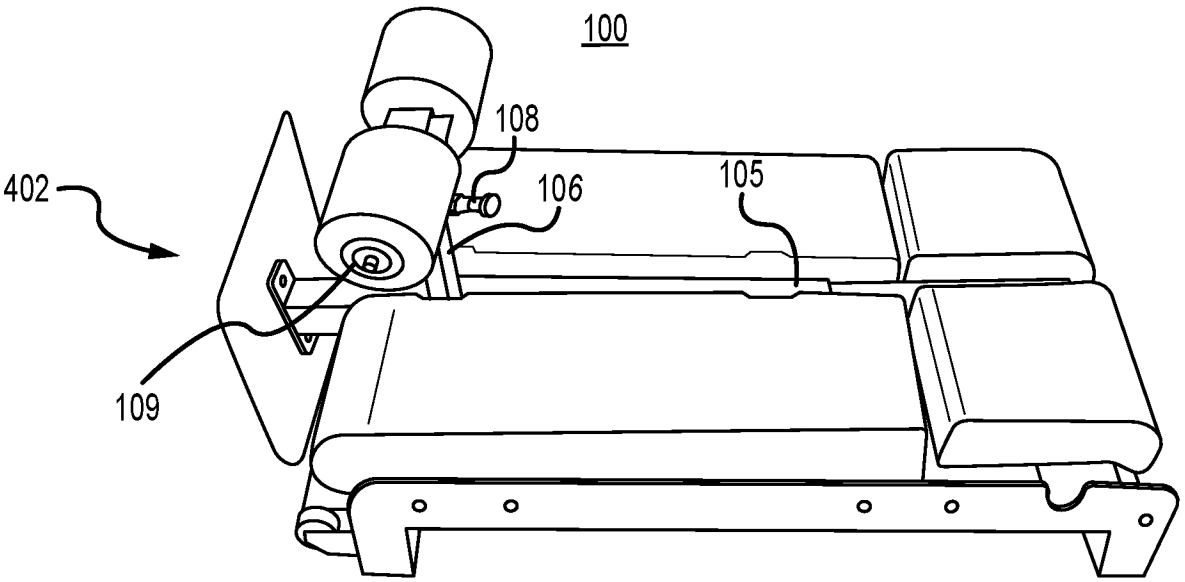
FIGS. 4A-4F illustrate a sequence of images showing a transition of an exemplary piece of exercise equipment from a first configuration to a second configuration.
Figure 4B:
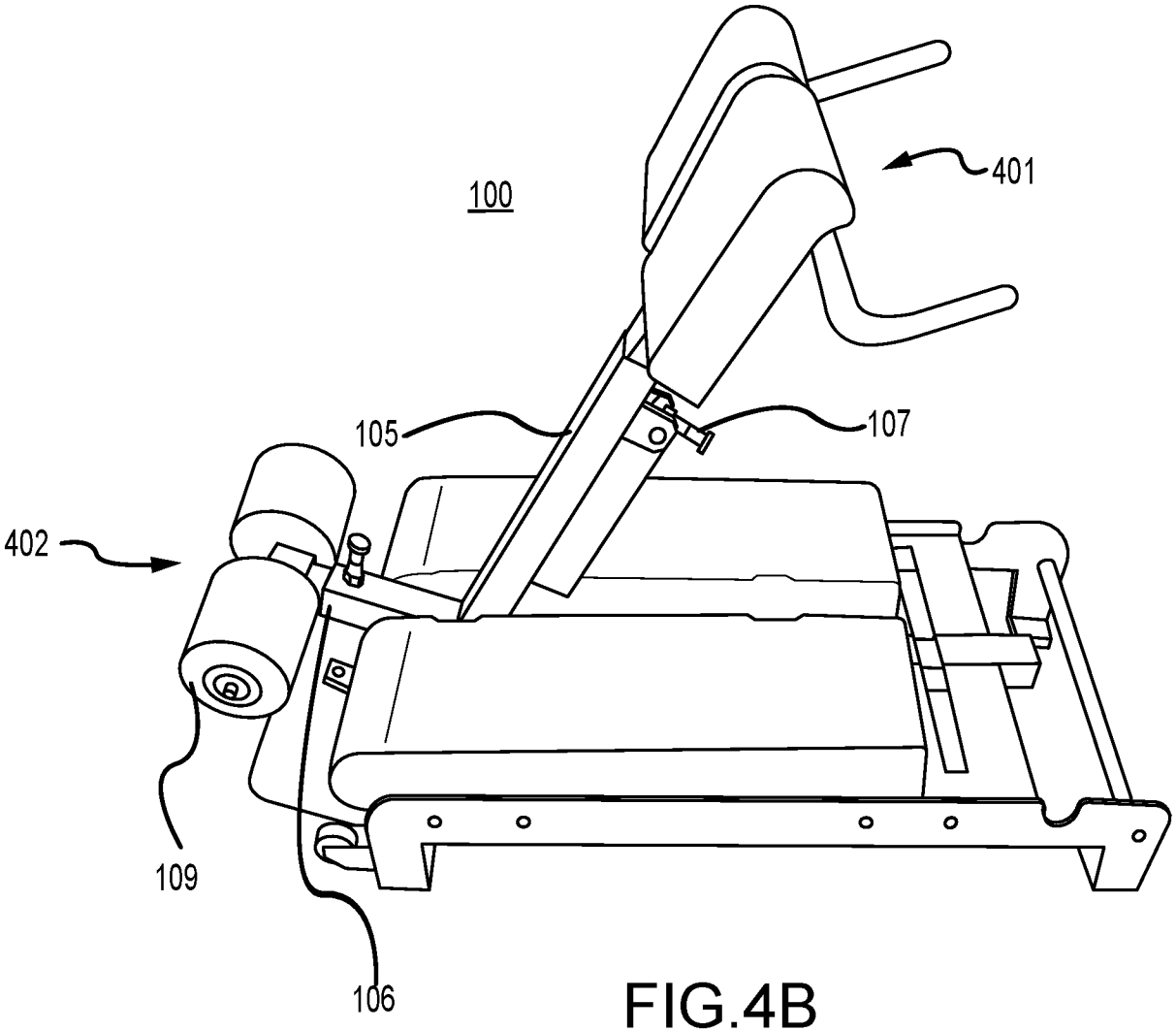
Figure 4C:
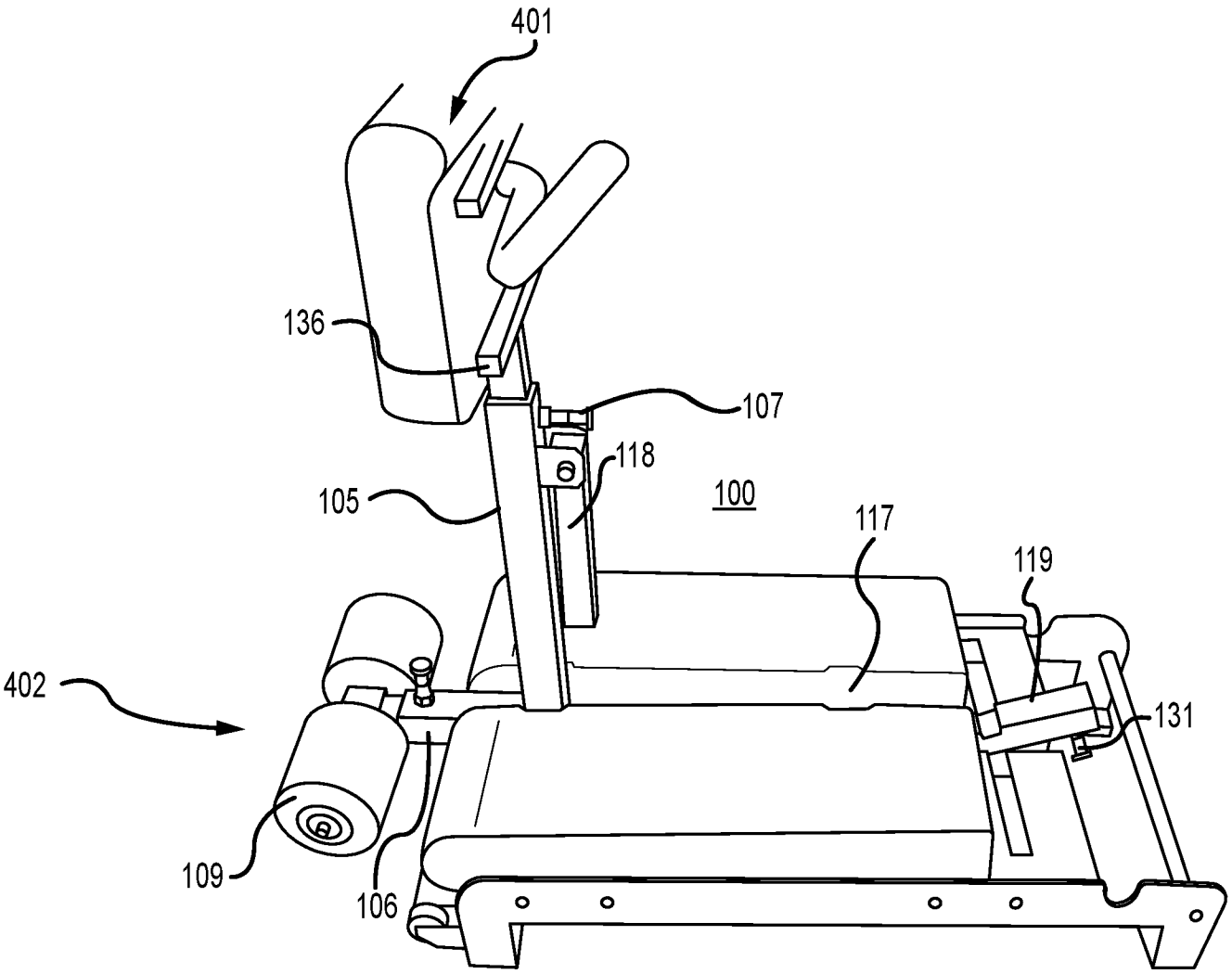
Figure 4D:
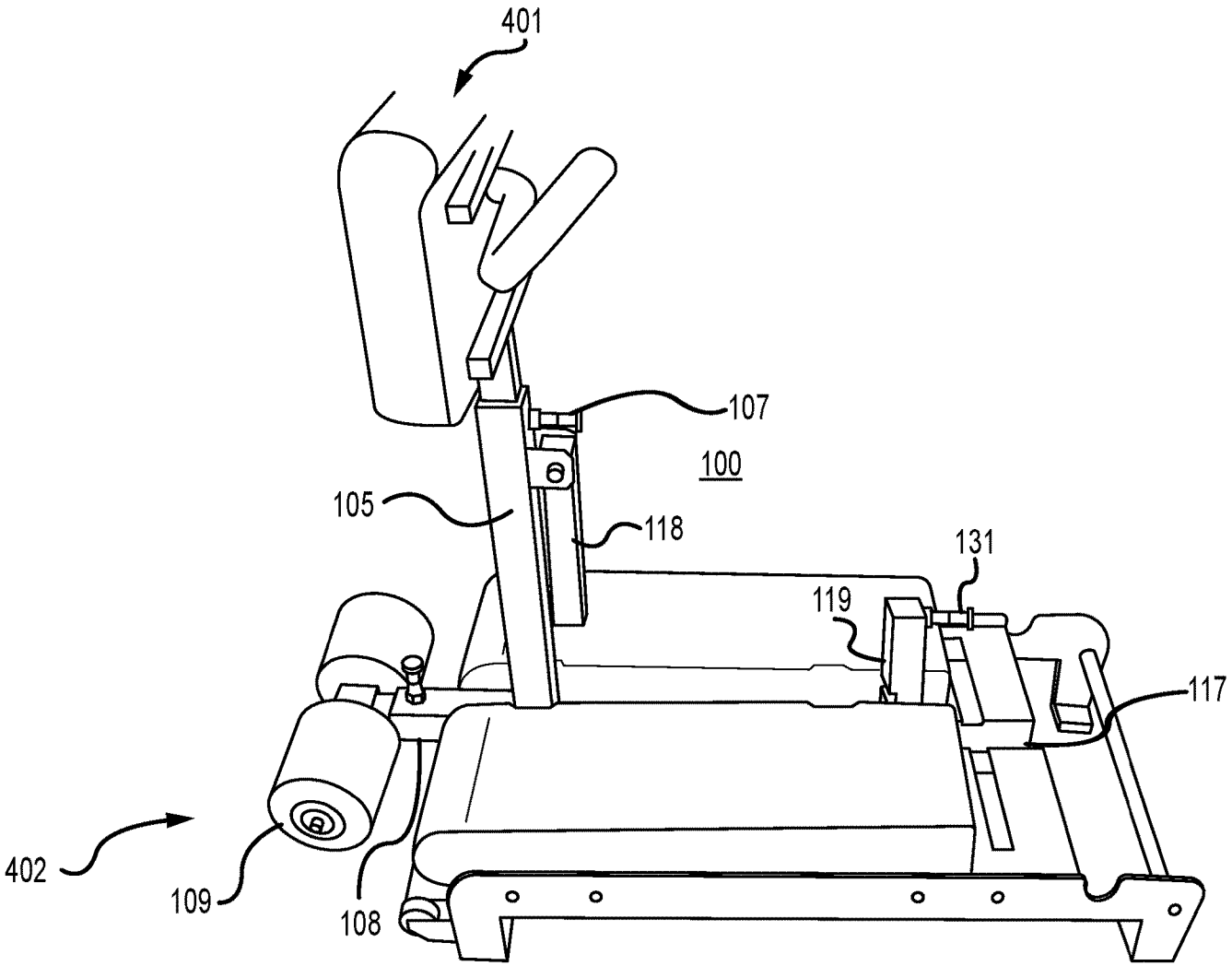
Figure 4E:
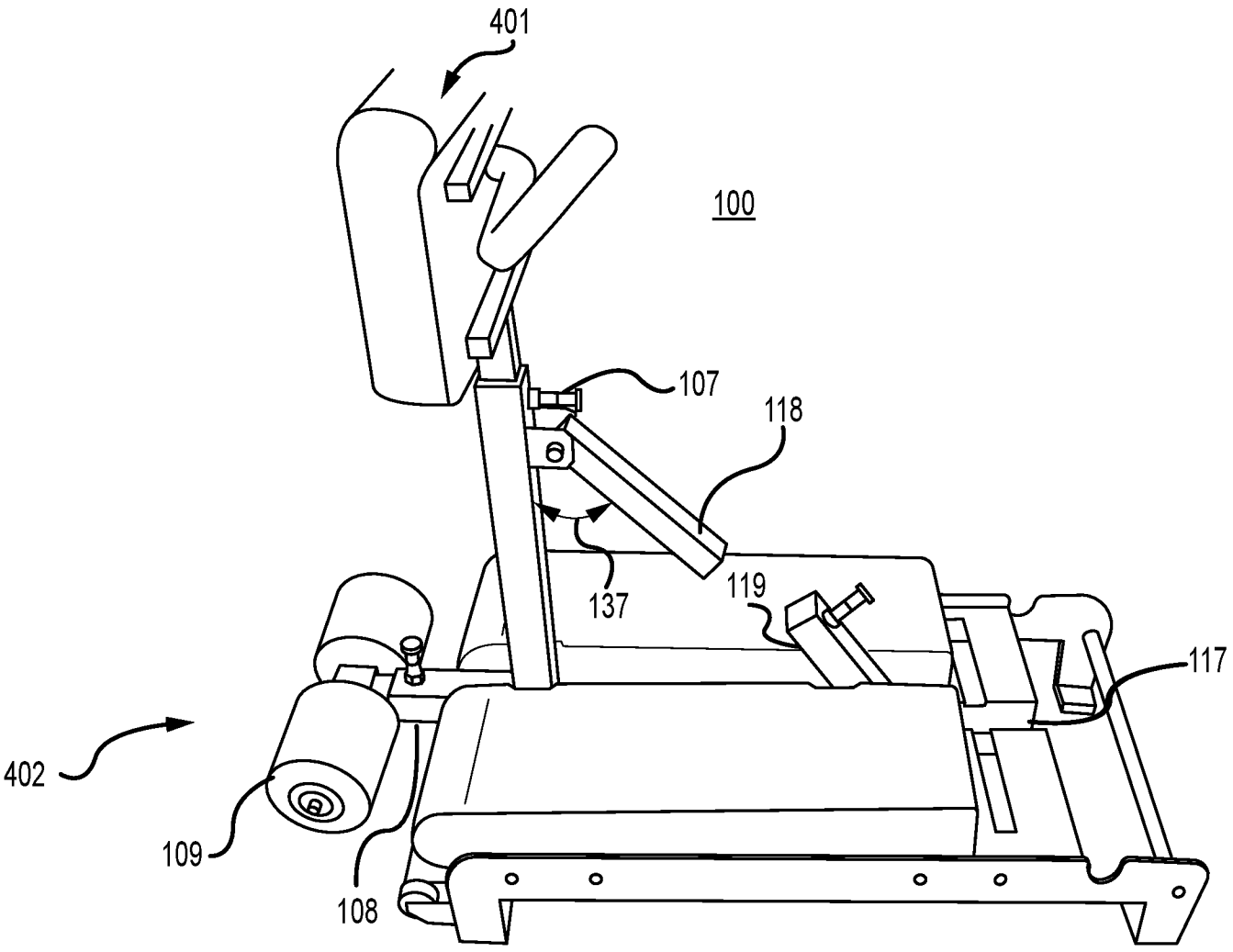
Figure 4F:
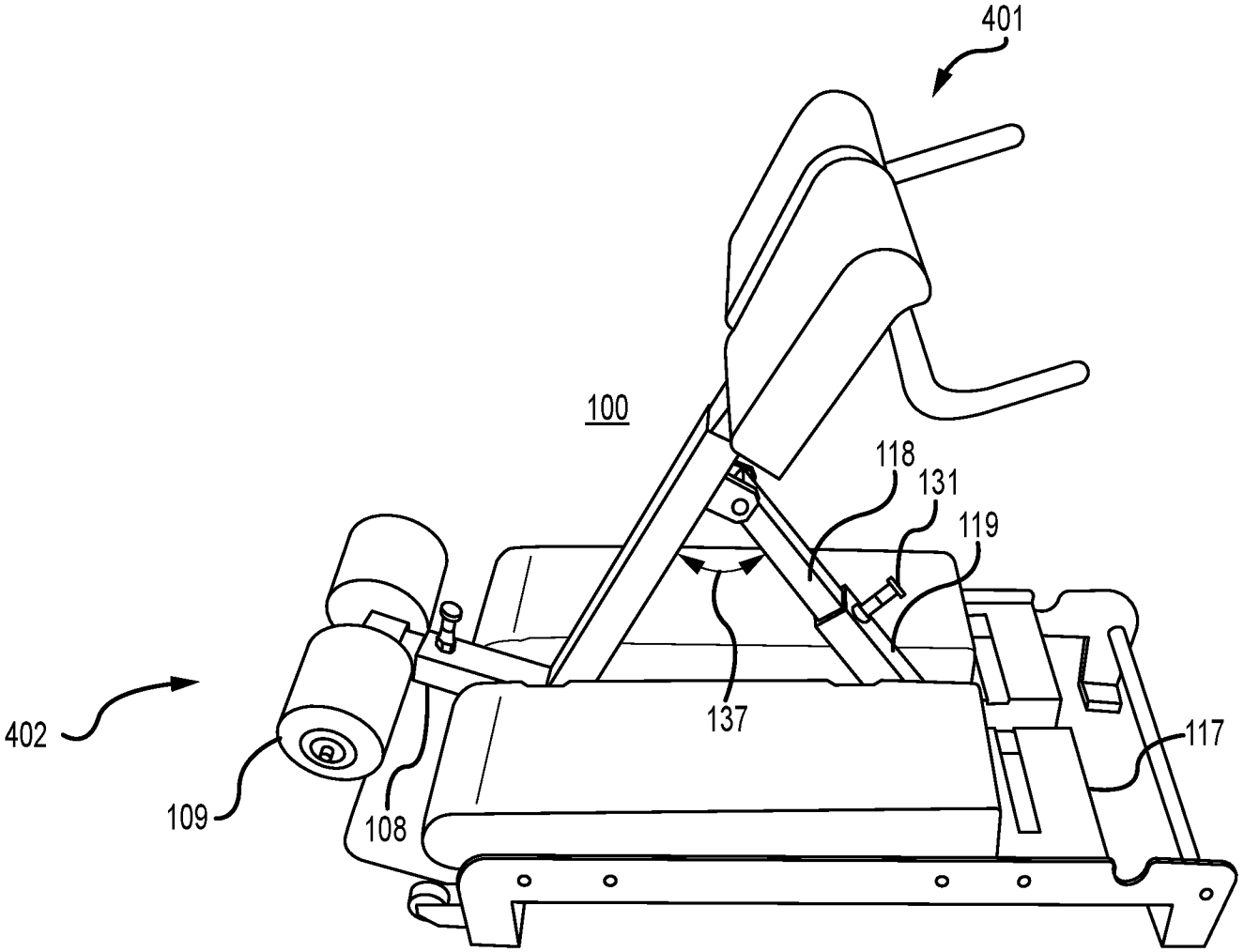

Equipment 100 can comprise a lateral frame 101, crossbar 103, fasteners 104 center post 105, ankle post 106, adjustment knob 107 (FIG. 4B), adjustment knob 108, ankle pads 109, hand grips 110, footrest 111, front top cushions 112 and 113, and/or wheel 124. Lateral frame 101 can be configured to couple to one or more rigid supports, such as crossbar 103, center post 105, and/or under panel 116. Crossbar 103 and/or under panel 116 can extend between two lateral frames 101, thereby providing protection against shearing and/or bending forces applied to equipment 100. In this way, equipment 100 can be stabilized so that vigorous exercise does not cause equipment 100 to collapse or tip over. Equipment 100 is shown in FIG. 1 in a first configuration (also referred to as a lowered configuration, a Nordic bench configuration, or a collapsed configuration). In various embodiments, lateral frame 101 can comprise foot 102 extending from and/or coupled to a body of lateral frame 101. The foot 102 can be configured to rest on the ground. A rubber sheath or sheet can be placed in between one or more foot 102 and the ground. In this way, equipment 100 can be prevented from damaging the ground and/or friction between equipment 100 and the ground can be increased, thereby preventing equipment 100 from shifting during use. Two or more lateral frames 101 can be coupled together using one or more crossbars 103 and/or under panel 116, thereby increasing structural stability when in equipment 100 is in use or being transported to a different location. Additional elements of equipment 100 can be coupled to lateral frame 101 via one or more fasteners 104. For example, a nameplate or logo can be coupled to lateral frame 101 via one or more fasteners 104. While shown in FIG. 1 as bolts, fastener 104 can comprise other fasteners known in the art suitable for the forces exerted on equipment 100 (e.g., nails, adhesive, rivets, welds, etc.).

In some embodiments, center post 105 can extend between and two or more lateral frames 101 when in a first configuration. The center post 105 can be aligned with an approximate midline 135 of equipment 100 and/or run from a front portion 401 of equipment 100 to a back portion 402 of equipment 100. Center post 105 can be hingedly coupled to under panel 116 and can actuate at a hinged point to transition from a first configuration to a second configuration. Center post 105 can be coupled to under panel 116 near a back portion 402 of equipment 100. In this way, when center post 105 is actuated at the hinge point to transition between the first and second configuration, a longer portion of center post 105 will be raised away from the ground while a shorter portion of center post 105 will be lowered towards the ground. Center post 105 can comprise center sheath 126 and center peg 127. A telescopic length of center post 105 can be changed by actuating adjustment knob 107 (FIG. 4B) and moving center peg 127 so that more or less of center peg 127 is within center sheath 126. Center peg 127 can have a number of cutouts and/or punches removed so that it can be fixed in a number of different positions within center sheath 126.

Ankle post 106 can extend out of a top and/or bottom surface of center post 105 and/or be integrated with center post 105. In many embodiments, ankle post 106 and/or center post 105 can produce one or more fixed and/or immovable angles relative to each other. For example, ankle post 106 and center post 105 can produce an approximately 90° angle relative to each other. Ankle post 106 can comprise ankle peg 132 and/or crossbar 133. The crossbar 133 can run through an approximate midline 134 of ankle pads 109. The ankle pads 109 can freely rotate around crossbar 133. A telescopic length of ankle post 106 can be changed by actuating adjustment knob 108 and moving ankle peg 132. While adjustment knobs 107 (FIG. 4B) and 108 are shown in FIG. 1 as traditional pop pin mechanism, adjustment knobs 107 (FIG. 4B) and 108 can each comprise other mechanisms known in the art for arresting telescopic motion. Ankle pads 109 can extend laterally out from ankle peg 132 on crossbar 133. Ankle pads 109 can be padded, cushioned, and/or have an outer surface capable of withstanding moisture. In this way, ankles of an athlete can be protected from injury during exercise while at the same time protecting equipment 100 from deterioration due to sweat.

In many embodiments, hand grip 110 can be coupled to center post 105 and/or crossbar 136 proximate to a front portion 401 of equipment 100. While hand grip 110 is shown in FIG. 1 as having an approximately "L" shape, other shapes can also be used. For example, hand grip 110 can have no bends and extend straight out from a front portion 401 of equipment 100. In some embodiments, all or a portion of hand grips 110 can be encased in a tacky substance (e.g., rubber, vinyl, etc.). In this way, a grip of an athlete on hand grip 110 can be maintained even in the presence of moisture (e.g., hand sweat). In various embodiments, hand grips 110 can be received by cutout 120 on lateral frame 101 when equipment 100 is in a first configuration.

Footrest 111 can be coupled to and/or integrated with center post 105 and/or ankle post 106 near a back portion 402 of equipment 100. The footrest 111 can have a substantially planar shape suitable for providing a stable resting place for an athlete's feet when in use. In many embodiments, footrest 111 can have an edge 128 that is bent toward the athlete. In this way, footrest 111 can provide improved stability for an athlete by preventing their foot from slipping off a bottom of the footrest 111. In some embodiments, a back surface of bent edge 128 can rest flat on the ground when equipment 100 is in a second configuration, thereby further increasing stability. In various embodiments, all or a portion of footrest 111 can be covered in a tacky substance (e.g., rubber, vinyl, etc.). In this way, footrest 111 can provide a stable platform even in the presence of moisture (e.g., sweat or water).

Front top cushions 112, 113 and/or back top cushions 114, 115 can be coupled to one or more of side panel 101, center post 105, ankle post 106, and/or under panel 116. Front top cushions 112, 113 and/or back top cushions 114, 115 can be padded, cushioned, and/or have an outer surface capable of withstanding moisture. For example, front top cushions 112, 113 and/or back top cushions 114, 115 can be made from a soft foam material. In this way, a body of an athlete can be protected from injury during exercise while at the same time protecting equipment 100 from deterioration due to sweat. Top cushions 112-115 can come in a number of different ornamental shapes and/or colors. For example, FIG. 1 displays top cushions 112-115 as having ornamental, rounded front and back edges. Other top cushion shapes can also be used with equipment 100. The function of cushions 112-115 can vary depending on whether equipment 100 is in a first configuration or a second configuration. For example, in a first configuration, front top cushions 112, 113 can support an athlete's knees, shins, or not be in use. Other examples of equipment in use are shown in FIGS. 9A-12B below.

Figure 2:
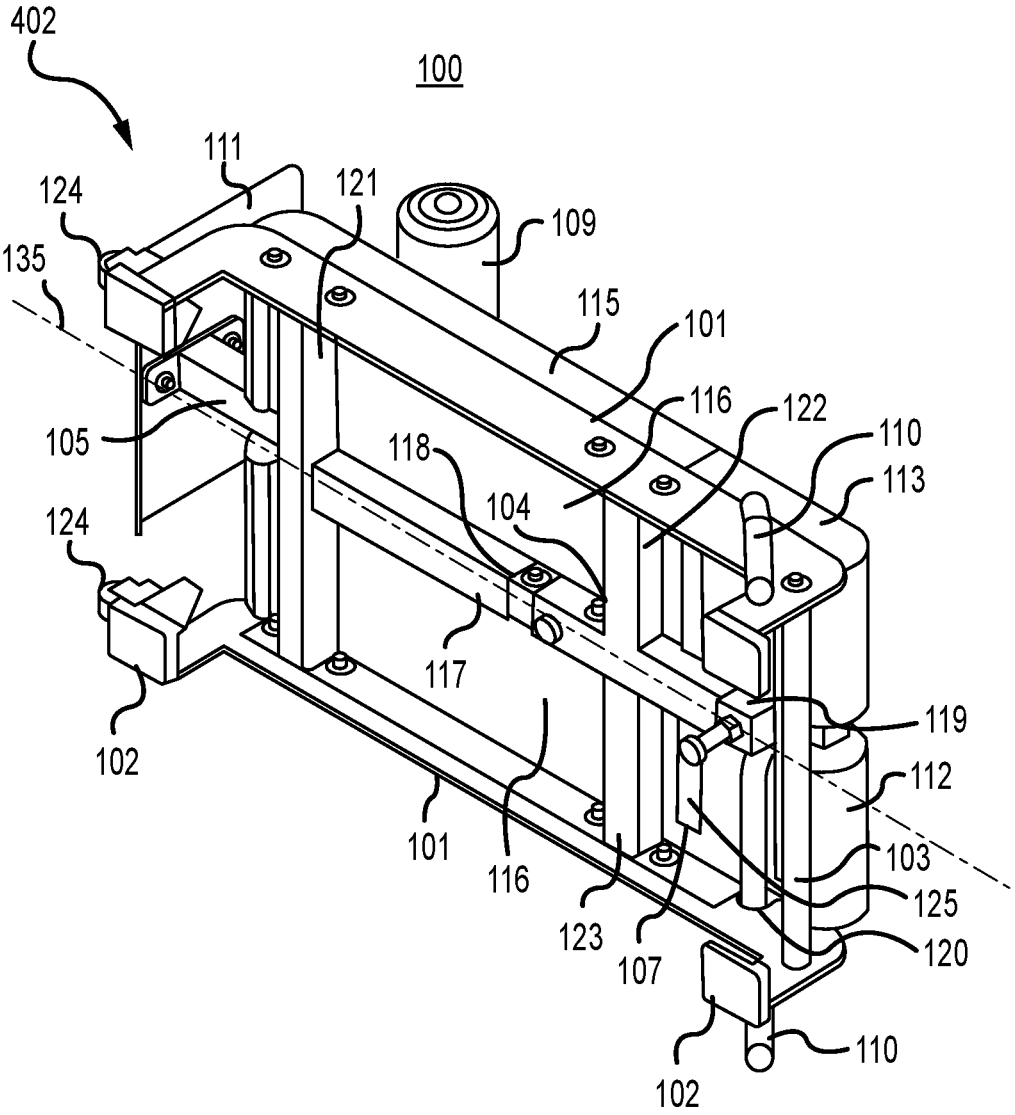
FIG. 2 illustrates a bottom isometric view of an exemplary piece of exercise equipment in a first configuration.

Turning now to FIG. 2, a bottom side isometric view of equipment 100 is shown. Under panel 116 can be substantially planar and can support back top cushions 114, 115. The under panel 116 can form a variety of topologies and/or have a variety of structures coupled to it. For example, under panel 116 can comprise trench 117 and/or bottom crossbars 121-123. The trench 117 can have an open top and be configured to receive one or more of peg 118 and/or sheath 119 when equipment 100 is in a first configuration. Peg 118 can be hingedly coupled to center post 105. When in a first configuration, peg 118 can be stored underneath center post 105 and/or within trench 117. Sheath 119 can be stored within trench 117 and/or underneath one or more of center post 105 and peg 118. The sheath 119 can be hingedly coupled to bottom panel 116 within trench 117 at a hinged point. Hinged coupling points for peg 118 and/or sheath 119 can be located along a midline 135 of equipment 100. In many embodiments, peg 118 and/or sheath 119 can be coupled to center post 105 or under panel 116 such that an angle between center post 105 and under panel 116 and/or the ground can range between thirty-five and fifty-five degrees.

Much like crossbar 103, bottom crossbars 121-123 increase structural stability when in equipment 100 is in use or being transported to a different location. The bottom crossbars 121-123 can be couple to and/or formed out of side panels 101 and/or under panel 116. In various embodiments, under panel 116 can comprise one or more cutouts 125. In some embodiments, cutouts 125 can be configured to allow crossbar 136 and/or mounting hardware for front top cushions 112, 113 to pass into or below a plane formed by a flat portion of under panel 116. In this way, equipment can be more compact when in a first configuration.

Wheels 124 can be coupled to feet 102 and be configured to support a weight of equipment 100 when in transit. In some embodiments, wheels 124 can be configured to allow equipment 100 to be transported and/or moved when not in use. Equipment 100 can be moved by lifting front portion 401 so that only wheels 124 are in contact with the ground. The equipment 100 can then be wheeled to its destination. Front portion 401 of equipment 100 can be lifted for transport by grasping and raising one or more of crossbar 103 and/or lateral frame 101. Front top cushions 112-113 and/or handgrips 110 can also be used in a similar fashion to transport equipment 100, but only when top portion 129 is in a locked and/or fixed position.

Figure 3:
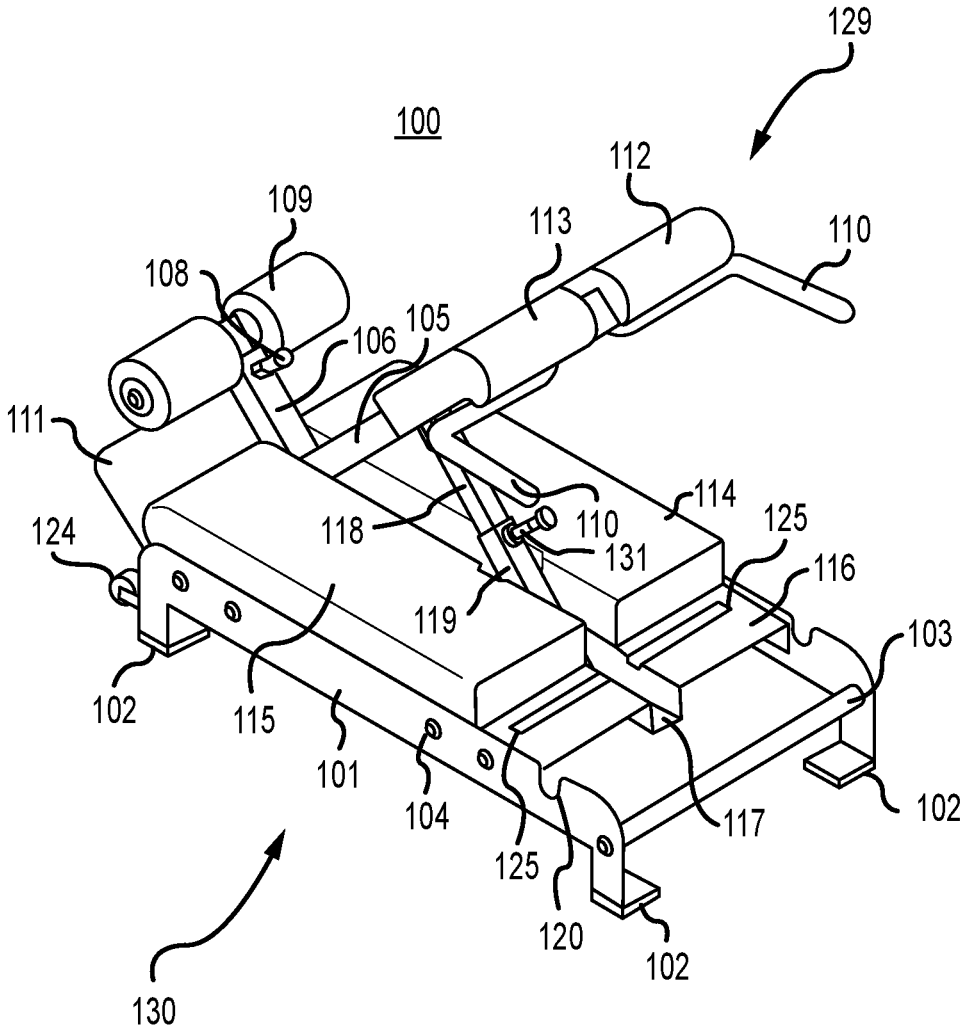
FIG. 3 illustrates an isometric view of an exemplary piece of exercise equipment in a second configuration.

Turning now to FIG. 3, an isometric view of equipment 100 is shown in a second configuration (also known as a raised configuration, a Roman chair configuration, or an expanded configuration). In many embodiments, equipment 100 can be transitioned from a first configuration to a second configuration by actuating top portion 129 relative to bottom portion 130 and/or coupling peg 118 to sheath 119. Top portion 129 can comprise center post 105, ankle post 106, adjustment knob 107 (FIG. 4B), adjustment knob 108, ankle pads 109, hand grips 110, footrest 111, front top cushions 112 and 113, and/or peg 118. Bottom portion 130 can comprise lateral supports 101, crossbar 103, back top cushions 114 and 115, under panel 116, and/or sheath 119. This transition can be accomplished by raising one or more of hand grips 110 and/or front top cushions 112, 113. Equipment 100 can also be transitioned from a first configuration to a second configuration by lowering ankle post 106, ankle pads 109, and/or footrest 111. In these embodiments, a portion of footrest 111 (e.g., edge 128 (FIG. 1)) can be moved underneath and/or into bottom portion 130. Equipment 100 can be locked and/or secured in a second configuration using adjustment knob 131, which can be similar to adjustment knobs 107 (FIG. 4B), 108. Adjustment knob 131 can be coupled to sheath 119 and be configured to secure peg 118 within sheath 119 in an approximately fixed position. Peg 118 can have a number of cutouts and/or punches removed so that peg 118 can be fixed in a number of different positions within sheath 119. In this way, an angle 137 created by top portion 129 relative to bottom portion 130 can be adjusted. For example, when peg 118 is secured deeper in sheath 119, angle 137 is decreased. In some embodiments, angle 137 can be adjusted in predetermined increments dictated by the cutouts on peg 118. For example, the cutouts can be spaced such that angle 137 is adjusted by five degree increments when knob 131 is moved between the cutouts.

Turning now to FIGS. 4A-4F, a sequence of images is shown illustrating the transition of an embodiment of a piece of exercise equipment 100 from a first configuration to a second configuration. To actuate the transition, front portion 401 of equipment 100 can be lifted, thereby lowering a back portion 402 of equipment 100 and removing center post 105 from trench 117. The peg 118 can then be lowered from underneath center post 105 and/or sheath 119 can be raised out of trench 117. Peg 118 can be inserted into sheath 119 to couple the two together. Adjustment knob 131 can then be used to lock sheath 119 and peg 118 in place, thereby stabilizing equipment 100 in a second configuration. In some embodiments, a height of front portion 401 can be adjusted by varying a portion of peg 118 inserted into sheath 119, thereby altering angle 137 of peg 118.

Figure 5:
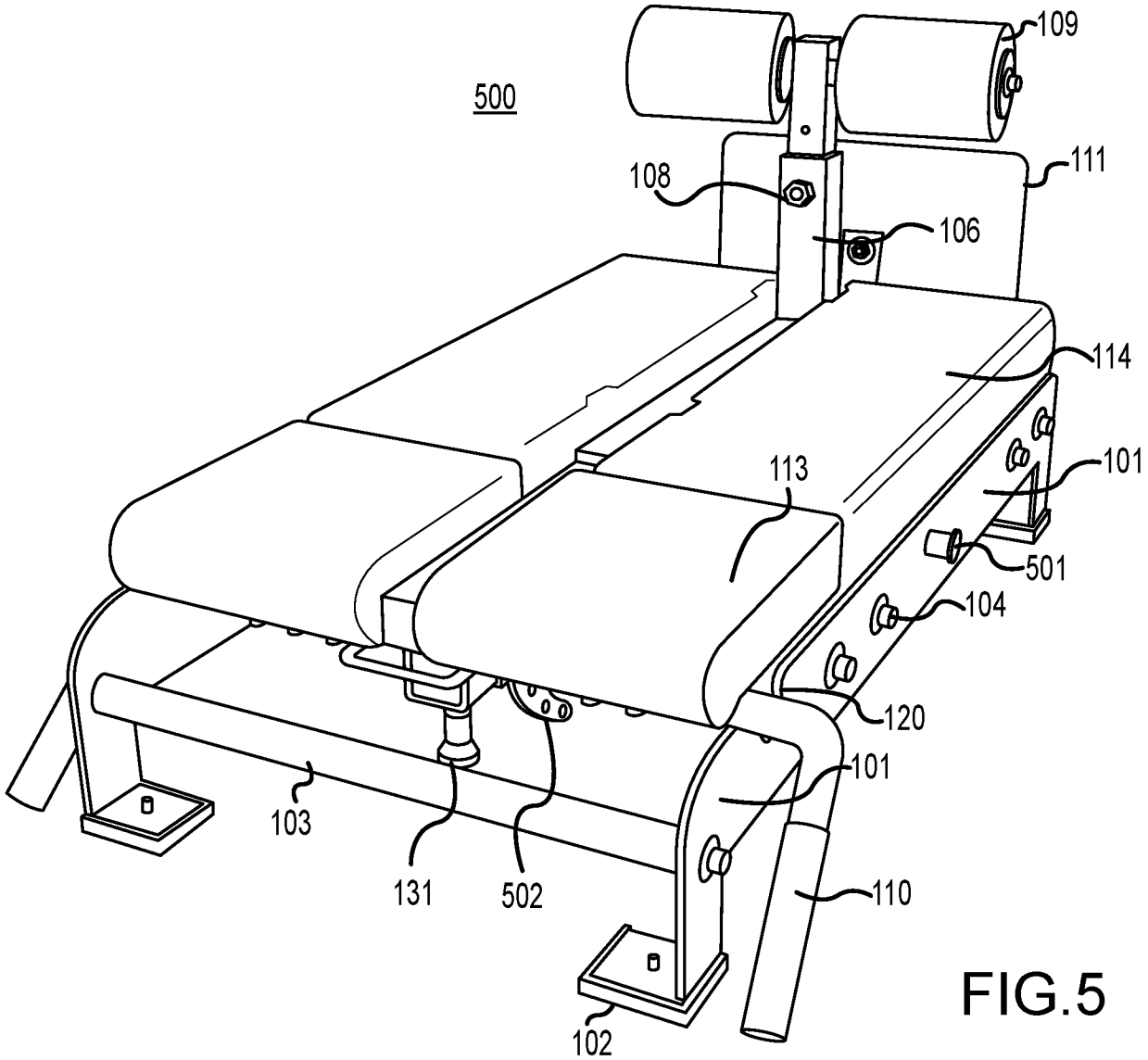
FIG. 5 illustrates an isometric view of an exemplary piece of exercise equipment in a first configuration.

Turning ahead in the drawings, FIG. 5 illustrates an exemplary piece of exercise equipment 500 in a first configuration. Equipment 500 is merely exemplary and is not limited to the embodiments presented herein. Equipment 500 can be employed in many different embodiments or examples not specifically depicted or described herein. Generally speaking, elements of equipment 500 can be made from a variety of materials. For example, elements of equipment 500 can be made from metal, wood, ceramic, plastic, or some other rigid and/or semi rigid material. Exercise equipment 500 can be similar in many respects to exercise equipment 100 (FIGS. 1-4F) and shares a number of elements with equipment 100. In various embodiments, equipment 500 can comprise a safety lock 501 and/or an assistance track 502.

Figure 6:
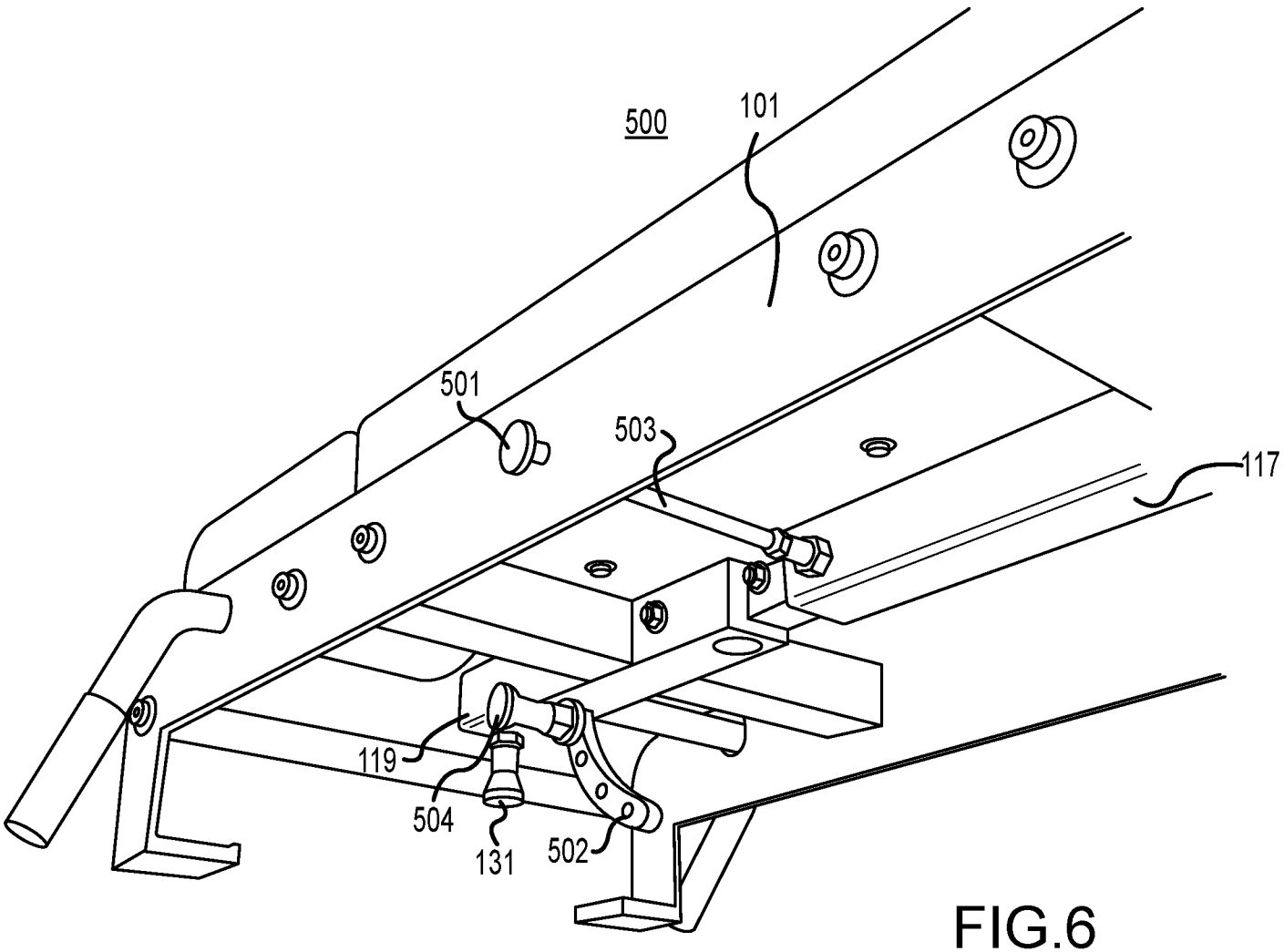
FIG. 6 illustrates a bottom isometric view of an exemplary piece of exercise equipment in a first configuration.

Turning ahead in the drawings, FIG. 6 illustrates an underside of exercise equipment 500 in a lowered configuration. Safety lock 501 can extend from an exterior of lateral frame 101, through trench 117, and/or into center post 105. In embodiments where safety lock 501 extends from an exterior of lateral frame to trench 117, transit tube 503 can be used to allow safe passage of safety lock 501 through an underside of equipment 500. When safety lock 501 is inserted into center post 105, movement of center post 105 can be arrested within trench 117. In this way, equipment 500 can be made safer when in a curl configuration by preventing center post 105 from moving when equipment 500 is in use. While safety lock 501 is displayed here in a pop-pin configuration, other mechanisms can also be used to arrest center post 105 in trench 117. For example, a cover can be placed over trench 117. Assistance track 502 can extend downward from sheath 119 and/or be locked in place by assistance lock 504.

Figure 7:
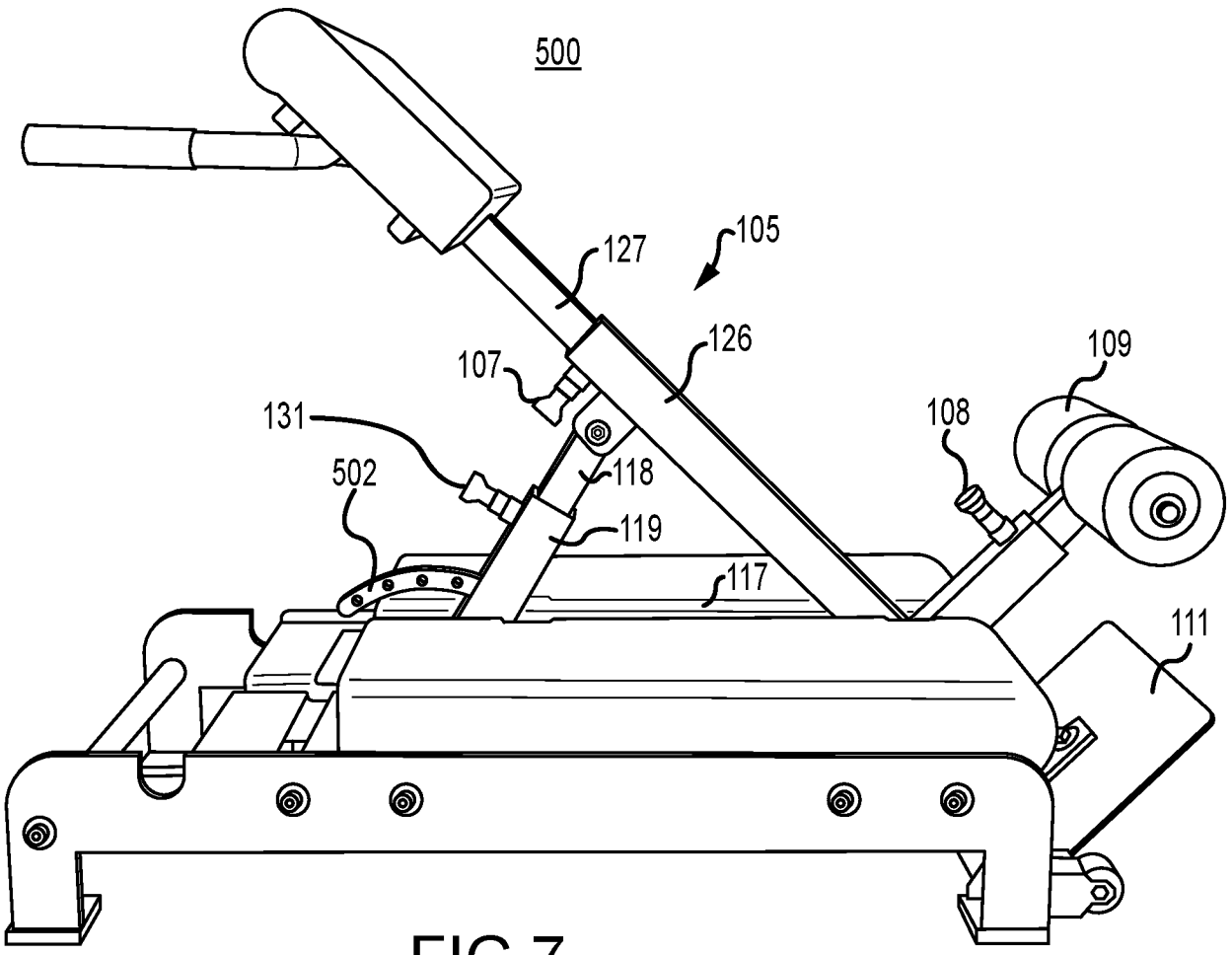
FIG. 7 illustrates a side view of an exemplary piece of exercise equipment in a second configuration.

Turning ahead in the drawings, FIG. 7 illustrates a side view of equipment 500 in a second configuration. Equipment 500 can be transitioned from a first configuration to a second configuration by disengaging one or more of safety lock 501 and/or assistance lock 504 (FIG. 6), thereby freeing central post 105 and sheath 119, respectively, to move freely in a hinged manner. Central post 105 and sheath 119 can then be raised out of trench 117. Sheath 119 can then be coupled with peg 118 to fix equipment 500 in the second configuration.

Figure 8:
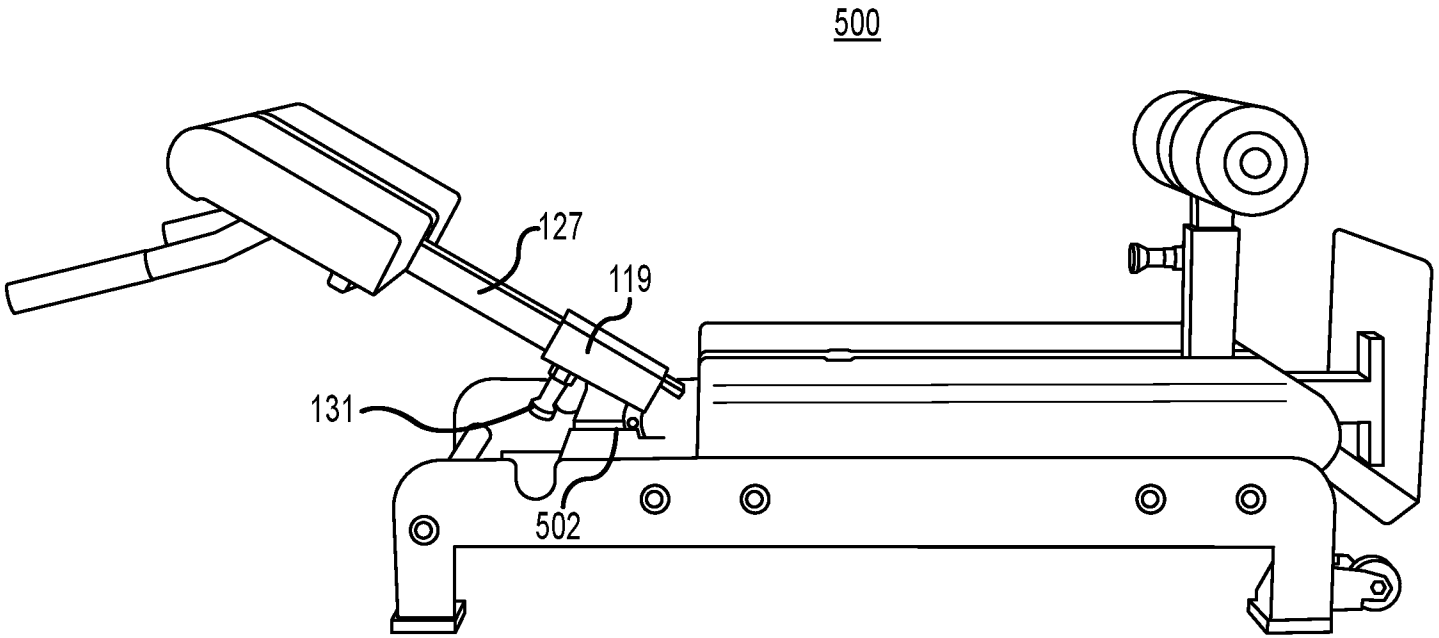
FIG. 8 illustrates a side view of an exemplary piece of exercise equipment in an assisted second configuration; and equipment.

Turning ahead in the drawings, FIG. 8 illustrates a side view of equipment 500 in an assisted second configuration (also referred to as an assisted raised configuration, an assisted Nordic curl configuration, or an assisted collapsed configuration). Equipment 500 can be transitioned to an assisted second configuration by removing center peg 127 from center sheath 126 and inserting it into sheath 119. A height and/or angle of sheath 119 can then be adjusted using assistance track 502 and assistance lock 504 (not shown). In this way, a range of motion (and therefore difficulty) of a Nordic curl can be lessened, as shown in FIGS. 10A-10B below.

Figure 9A:
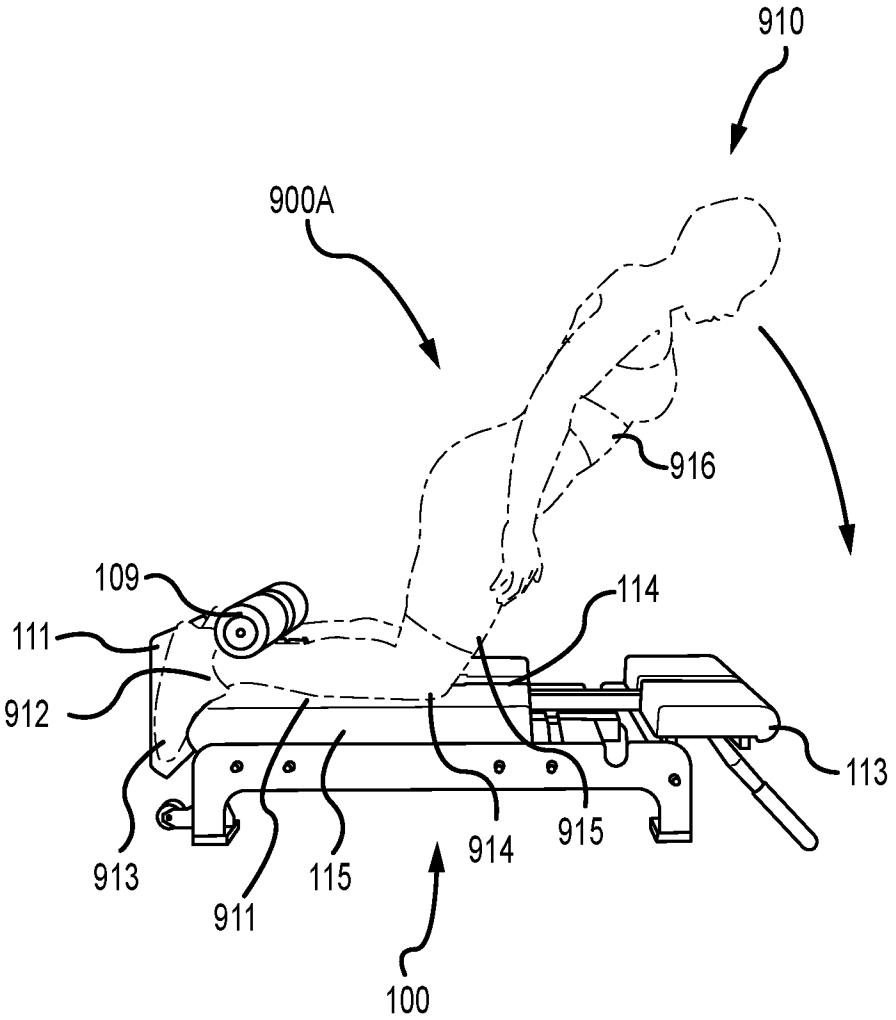
FIGS. 9A-12B illustrate side views of exemplary exercises performed on exercise equipment.
Figure 9B:
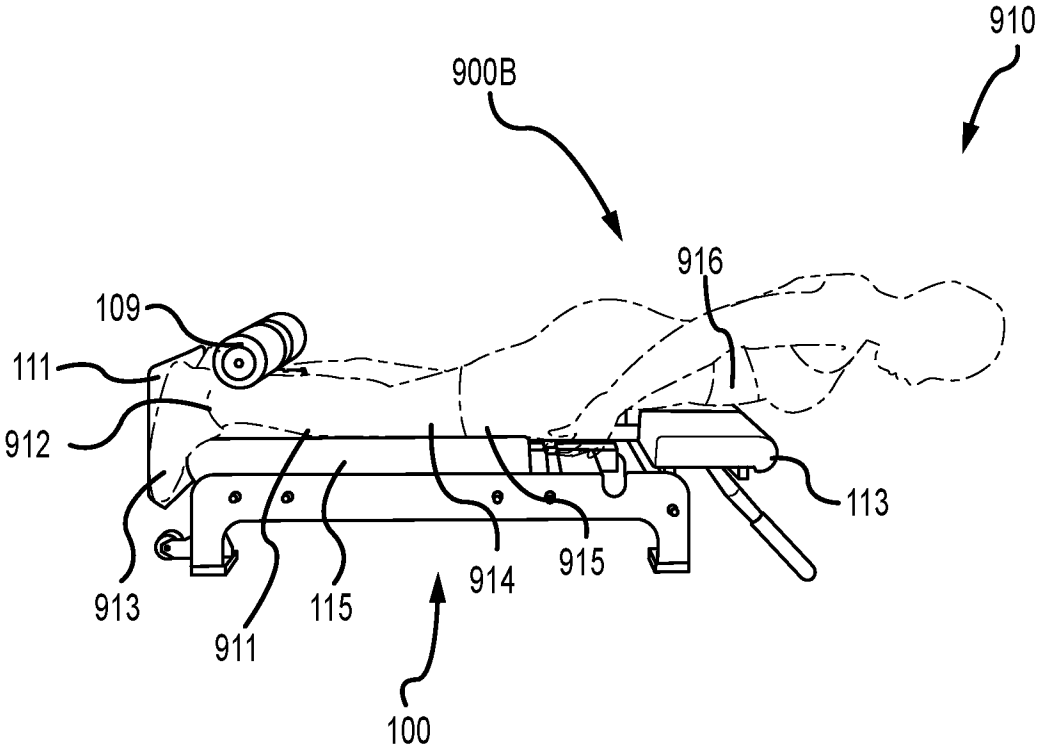

The ability of the equipment disclosed herein to transition between a first configuration and a second configuration allows the equipment to be used for a number of different exercises. Turning now to FIGS. 9A-9B, an exemplary athlete 910 performing a Nordic curl exercise on exercise equipment 100 is shown. A Nordic curl exercise is an exercise in which a person kneels with their feet in an approximately fixed position and then lowers their body by extending the knee. Position 900A of athlete 910 in FIG. 9A shows a starting point for a Nordic curl and position 900B in FIG. 9B shows an ending point for the Nordic curl. A shin 911 of athlete 910 can remain resting on back top cushions 114-115 and/or an ankle 912 of athlete 910 can be placed between back top cushions 114-115 and ankle pad 109. A foot 913 of athlete 910 can rest on or hover above footrest 111. As athlete 910 lowers themselves from position 900A towards position 900B, knee 914 is extended and/or an eccentric contraction is generated in the hamstring muscle group of athlete 910. In this way, athlete 910 can protect against posterior chain injury and improve hamstring strength. While position 900B is shown as having thigh 915 and torso 916 touching portions of equipment 100 (e.g., front top cushion 113 and/or back top cushion 114), it should be understood that position 900B can occur anywhere in the range of motion for the Nordic curl. Athlete 910 can reset to position 910A by flexing at knee 914, causing a concentric contraction of the hamstring muscle group, and/or at least partially exiting equipment 100 and re-entering equipment 100 in position 910A.

Figure 10A:
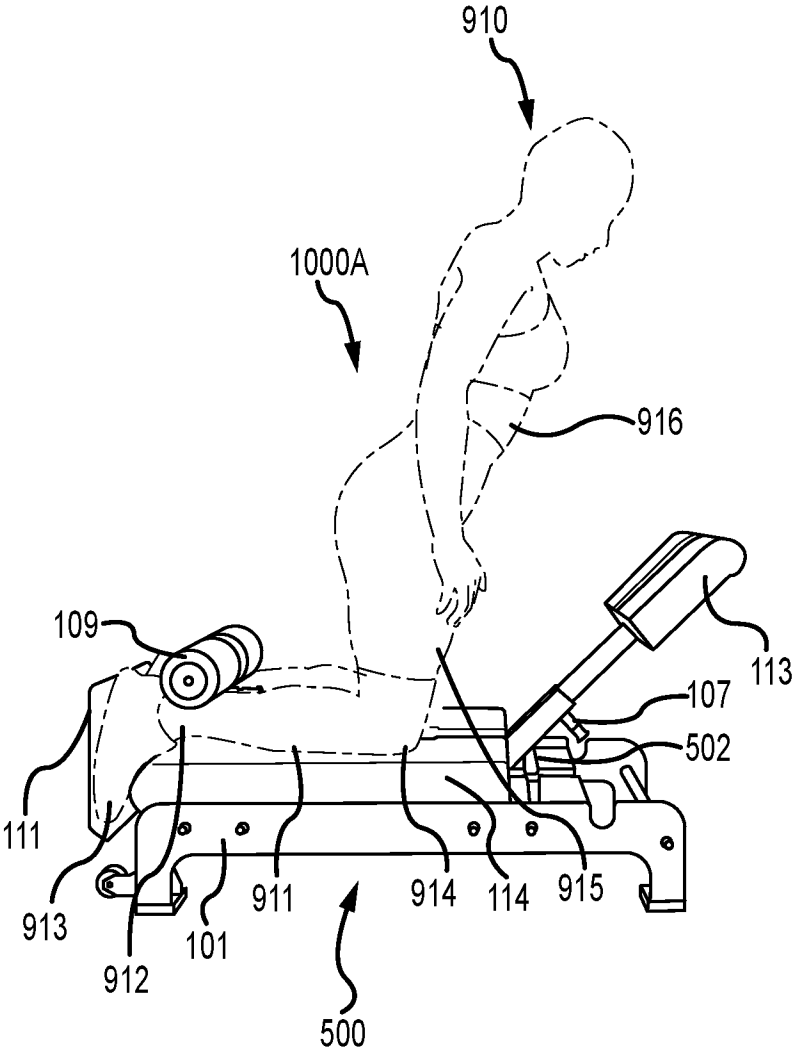
Figure 10B:
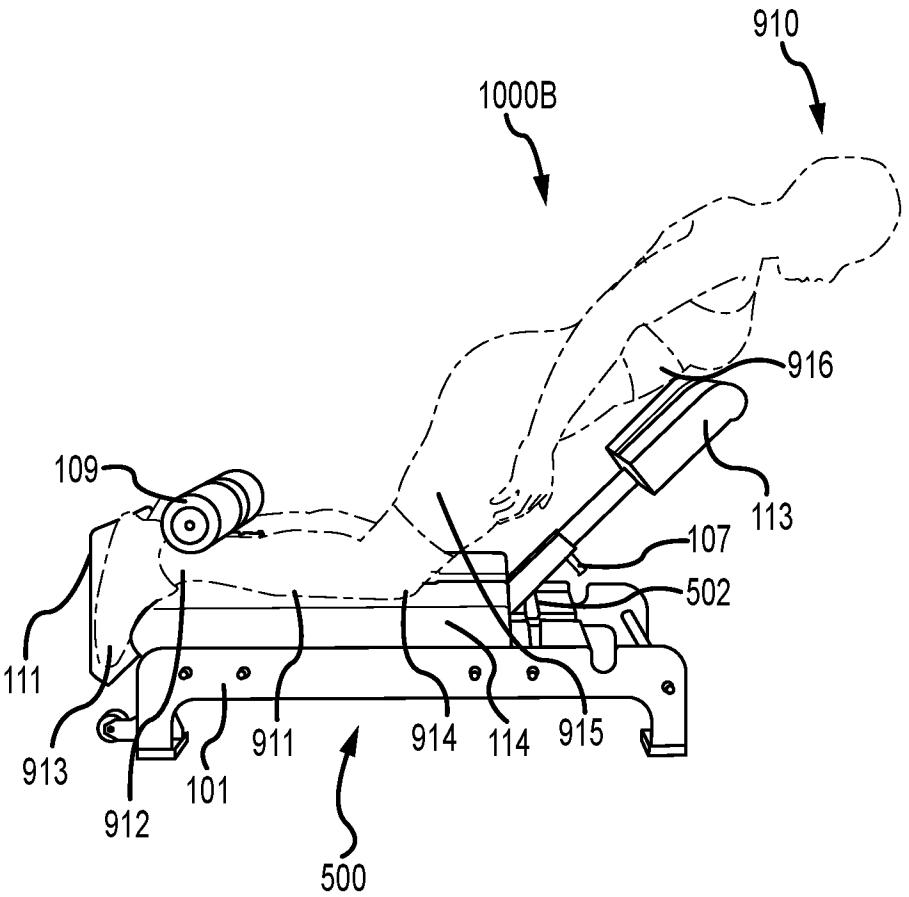

Turning now to FIGS. 10A-10B, athlete 910 is shown performing an assisted Nordic curl exercise on exercise equipment 500. An assisted Nordic curl exercise can be similar to a Nordic curl exercise but can have an abbreviated range of motion due to a raised position of front top cushion 113. When an assisted Nordic curl is performed, athlete 910 can start in position 1000A and lower themselves to position 1000B in a similar fashion to a Nordic curl. When in position 1000B, athlete 910 can rest their torso 916 on front top cushion 113. Athlete 910 can reset to position 1010A by flexing at knee 914, causing a concentric contraction of the hamstring muscle group, and/or at least partially exiting equipment 500 and re-entering equipment 500 in position 1010A.

Figure 11A:
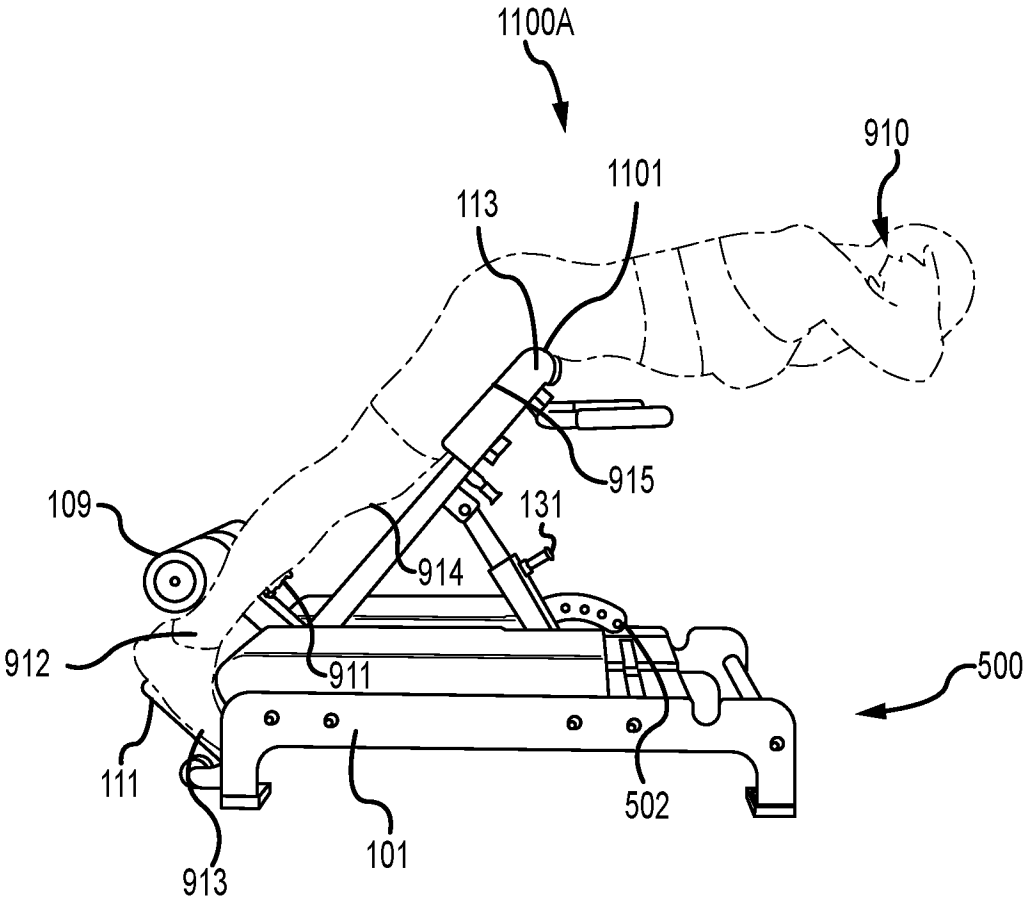
Figure 11B:
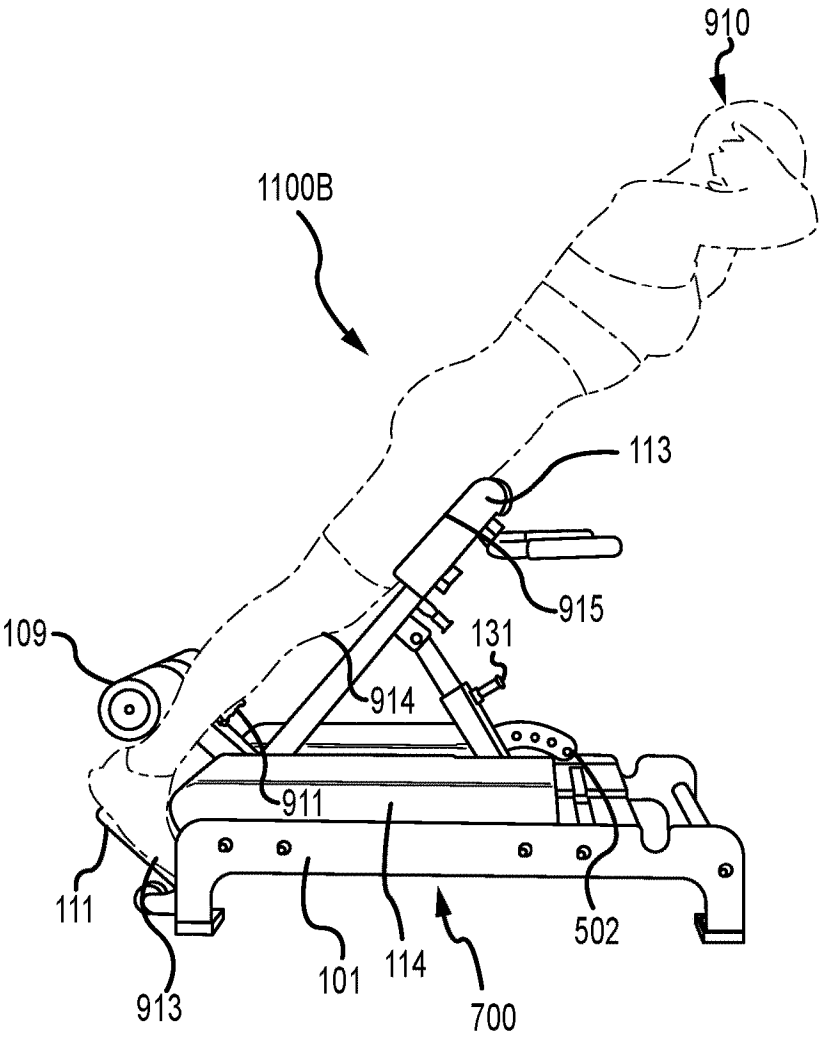

Turning now to FIGS. 11A-11B, athlete 910 is shown performing a back extension exercise (sometimes referred to as a back hyperextension exercise). A back extension exercise is an exercise in which a person stands or leans with their feet in a fixed position and then raises their body by extending their hip joint. When a back extension is performed on exercise equipment 500, athlete 910 can start in position 1100A and raise themselves to position 1100B by extending their hip joint 1101, thereby contracting a gluteus muscle group and a hamstring muscle group. A shin 911 of athlete 910 can float above back top cushions 114-115 and/or an ankle 912 of athlete 910 can be placed between back top cushions 114-115 and ankle pad 109. A foot 913 of athlete 910 can rest on or hover above footrest 111 and be placed partially underneath back top cushion 115. When in position 1100B, athlete 910 can rest their torso 916 on front top cushion 113. Athlete 910 can reset to position 1110A by flexing at knee 914, causing a concentric contraction of the hamstring muscle group, and/or at least partially exiting equipment 500 and re-entering equipment 500 in position 1110A. As compared to performing an assisted Nordic curl on equipment 500 or a Nordic curl on equipment 100 (FIG. 3), ankle 912 and/or foot 913 of athlete 910 can be rotated towards and/or moved underneath back top cushions 114-115. Further, while knee 914 can be resting on back top cushions 114-115 while performing a Nordic curl, it is suspended above back top cushions 114-115 while performing a back extension.

Figure 12A:
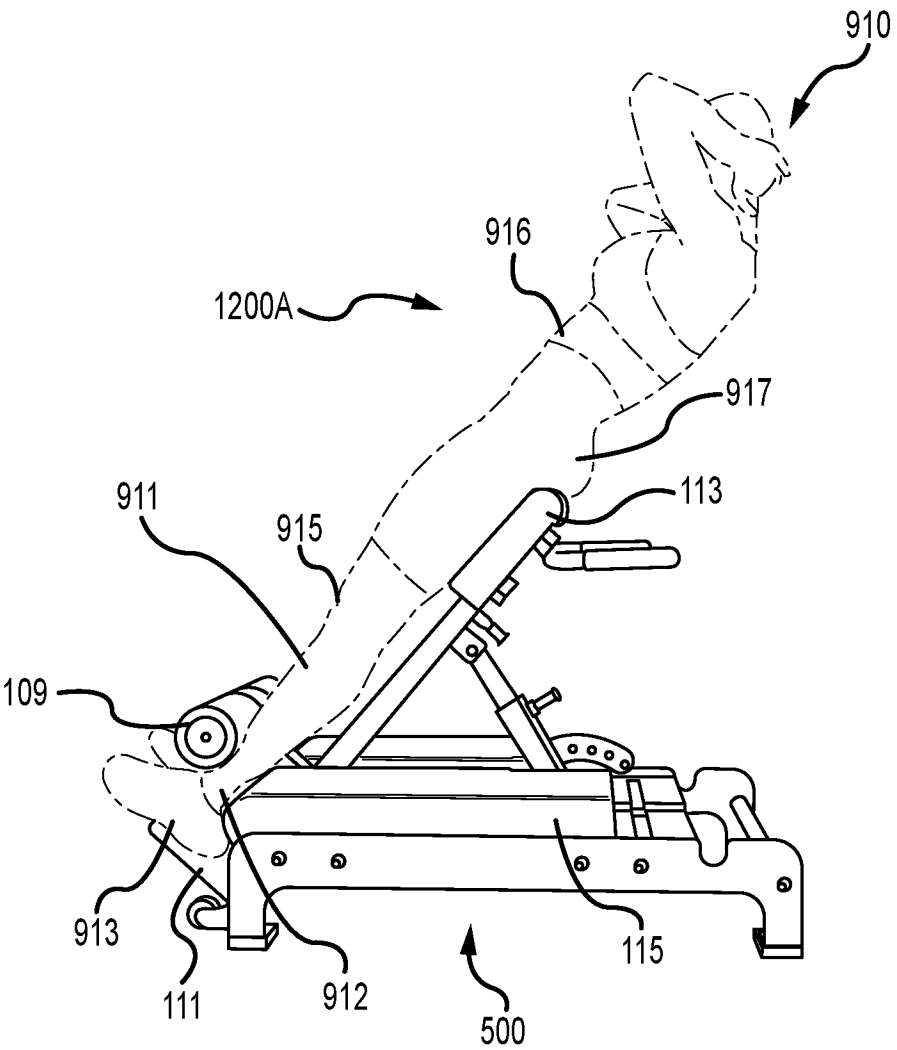
Figure 12B:
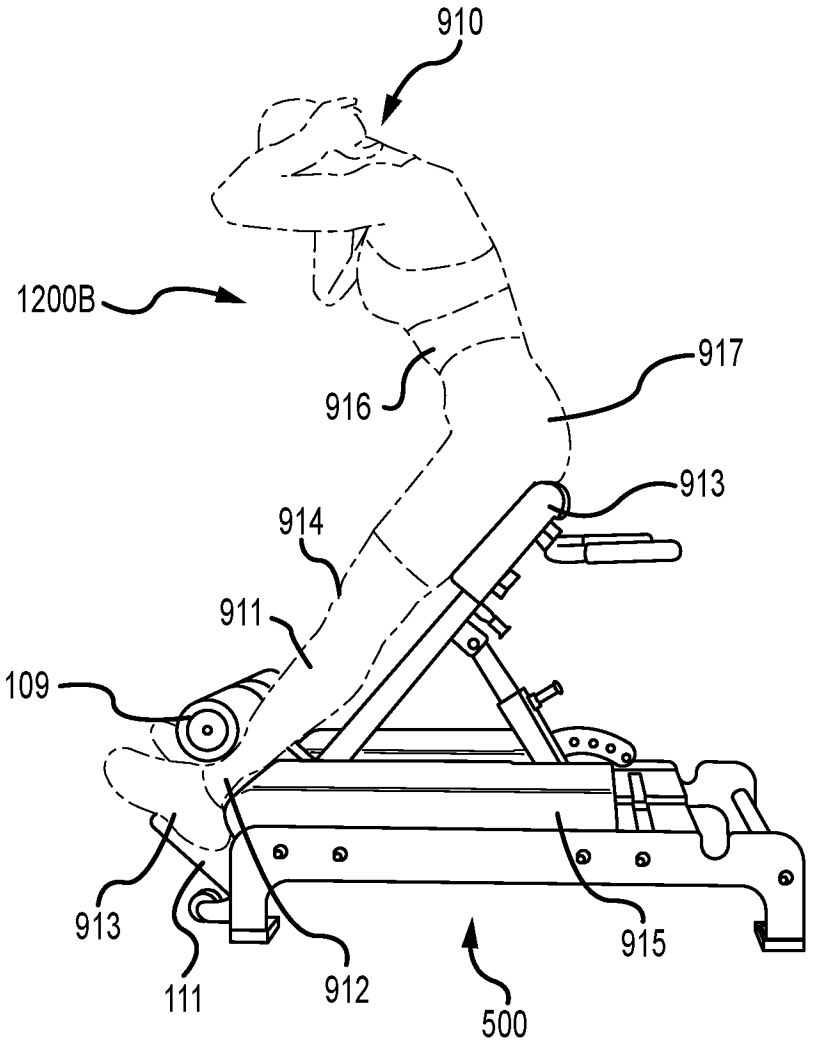

Turning now to FIGS. 12A-12B, athlete 910 is shown performing an inclined crunch exercise. An incline crunch exercise is an exercise in which a person stands at an incline to the ground with their feet in an approximately fixed position and then raises their torso by flexing the abdominal muscle group. Position 1200A of athlete 910 in FIG. 12A shows a starting point for a Nordic curl and position 1200B in FIG. 12B shows an ending point for the Nordic curl. A shin 911 and thigh 916 of athlete 910 can be approximately parallel with an incline of the inclined crunch and above back top cushions 114-115. An ankle 912 of athlete 910 can be placed between back top cushions 114-115 and ankle pad 109. A foot 913 of athlete 910 can rest on or hover above footrest 111 and/or be partially underneath back top cushion 115. A rump 917 of athlete 910 can rest on or be placed above from top cushion 113. As athlete 910 raises themselves from position 1200A towards position 1200B, torso 916 is contracted and/or a contraction is generated in an abdominal muscle group of athlete 910.

Although exercise equipment and related methods have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any element of FIGS. 1-5 may be modified, and that the foregoing discussion of certain of these embodiments does not necessarily represent a complete description of all possible embodiments. For example, one or more of the elements of FIG. 1 may include different configurations and/or different elements.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An exercise apparatus comprising:
- a top portion comprising:
  - a center post having a first end and a second end;
  - an ankle post coupled to a top surface of the center post;
  - a footrest having an approximately planar shape, coupled to the first end of the center post, and creating an approximately 90 degree angle with the center post, wherein the ankle post is located between the footrest and the second end; and
  - a cushion coupled to the top surface of the center post or a crossbar coupled to the center post;
- a bottom portion comprising a foot; and
- a peg hingedly coupled to the top portion, wherein:
  - the exercise apparatus is configured to transition from a lowered configuration where the top portion is in a lowered position to a raised configuration where the top portion is in a raised position by actuating the peg at a hinged coupling point; and
  - the center post, the footrest, and the ankle post remain in a same position relative to each other when in both the lowered position and the raised position.

2. The exercise apparatus of claim 1, wherein the peg is located underneath the center post of the top portion when the exercise apparatus is in the lowered configuration.

3. The exercise apparatus of claim 2, wherein the peg is further located in a trench of the bottom portion when the exercise apparatus is in the lowered configuration.

4. The exercise apparatus of claim 2, wherein:
- the top portion further comprises an ankle pad coupled to the ankle post;
- the ankle pad is lowered when the exercise apparatus is transitioned from the lowered configuration to the raised configuration; and
- the peg is raised when the exercise apparatus is transitioned from the lowered configuration to the raised configuration.

5. The exercise apparatus of claim 2, wherein the lowered configuration comprises a Nordic Bench and the raised configuration comprises a Roman Chair.

6. The exercise apparatus of claim 2, wherein the lowered configuration is configured for an athlete to perform a Nordic curl exercise and the raised configuration is configured for the athlete to perform a back extension exercise.

7. The exercise apparatus of claim 1, wherein a height of the raised configuration can be adjusted by altering a hinge angle of the peg before coupling the peg to the bottom portion.

8. A method for facilitating exercise with equipment capable of transitioning between two or more configurations, the method comprising:

providing a top portion of an exercise apparatus comprising:

a center post having a first end and a second end;

an ankle post coupled to a top surface of the center post;

a footrest having an approximately planar shape, coupled to the first end of the center post, and creating an approximately 90 degree angle with the center post, wherein the ankle post is located between the footrest and the second end; and a cushion coupled to the top surface of the center post or a crossbar coupled to the center post;

providing a bottom portion of the exercise apparatus comprising a foot;

providing a peg hingedly coupled to the top portion; and transitioning the exercise apparatus from a lowered configuration where the top portion is in a lowered position to a raised configuration where the top portion is in a raised position by actuating the peg at a hinged coupling point, wherein the center post, the footrest, and the ankle post remain in a same position relative to each other when in both the lowered position and the raised position.

9. The method of claim 8, wherein actuating the peg comprises actuating the peg located underneath the center post of the top portion at the hinged coupling point.

10. The method of claim 9, wherein actuating the peg further comprises actuating the peg located underneath the center post of the top portion and in a trench of the bottom portion at the hinged coupling point.

11. The method of claim 8, wherein:

providing the top portion comprises providing the top portion comprising the cushion and an ankle pad coupled to the ankle post;

the ankle pad is lowered when the exercise apparatus is transitioned from the lowered configuration to the raised configuration; and the peg is raised when the exercise apparatus is transitioned from the lowered configuration to the raised configuration.

12. The method of claim 8, wherein transitioning the exercise apparatus comprises transitioning the exercise apparatus from the lowered configuration comprising a Nordic Bench where the top portion is in the lowered position to the raised configuration comprising a Roman Chair where the top portion is in the raised position by actuating the peg at the hinged coupling point.

13. The method of claim 8, wherein transitioning the exercise apparatus comprises transitioning the exercise apparatus from the lowered configuration configured for an athlete to perform a Nordic curl exercise and where the top portion is in the lowered position to the raised configuration configured for the athlete to perform a back extension exercise and where the top portion is in the raised position by actuating the peg at the hinged coupling point.

14. The method of claim 8, wherein transitioning the exercise apparatus comprises transitioning the exercise apparatus from the lowered configuration where the top portion is in the lowered position to the raised configuration where the top portion is in the raised position by actuating the peg at the hinged coupling point and altering a hinge angle of the peg before coupling the peg to the bottom portion, thereby adjusting a height of the raised configuration.

15. A collapsed exercise apparatus comprising:

a center post;

a crossbar coupled to the center post;

a cushion coupled to the center post or the crossbar;

a hand grip coupled to the crossbar;

an ankle post coupled to the center post;

a peg hingedly coupled to the center post; and a footrest coupled to and creating an approximately 90 degree angle with the center post, wherein the ankle post is located between the footrest and the crossbar on the center post, wherein the collapsed exercise apparatus is configured to transition between a first collapsed configuration and a second expanded configuration by actuating the peg at a hinged coupling point, and wherein the center post, the footrest, and the ankle post remain in a same position relative to each other when in both the first collapsed configuration and the second expanded configuration.

16. The collapsed exercise apparatus of claim 15, wherein the center post is stored in a trench of an under panel.

17. The collapsed exercise apparatus of claim 15 further comprising a sheath hingedly coupled to an under panel and configured to receive the peg.

18. The collapsed exercise apparatus of claim 17, wherein the under panel is hingedly coupled to both the center post and the sheath.

19. The collapsed exercise apparatus of claim 15, wherein the crossbar is stored in a first cutout of an under panel and the hand grip is stored in a second cutout of the under panel, wherein the second cutout is different from the first cutout.

20. The collapsed exercise apparatus of claim 18, wherein the sheath is stored underneath the center post.

* * * * *